United States Patent [19]

Honnorat et al.

[11] 4,177,026

[45] Dec. 4, 1979

[54] DEVICE FOR THE MANUFACTURE OF SPHERICAL METALLIC POWDER

[75] Inventors: Yves C. Honnorat, Imphy; Gérard D. Raisson; Jean G. Morlet, both of Nevers, all of France

[73] Assignee: Creusot-Loire, Paris, France

[21] Appl. No.: 836,711

[22] Filed: Sep. 26, 1977

[30] Foreign Application Priority Data

Oct. 1, 1976 [FR] France ..... 76 29654

[51] Int. Cl.[2] ..... B22D 23/08

[52] U.S. Cl. ..... 425/7; 264/12

[58] Field of Search ..... 425/7; 264/12

[56] References Cited

U.S. PATENT DOCUMENTS

| | | | |
|---|---|---|---|
| 3,281,893 | 11/1966 | Ayers | 425/7 |
| 3,771,929 | 11/1973 | Hellman et al. | 425/7 |
| 3,819,310 | 6/1974 | Mavrovis | 425/7 X |
| 3,856,441 | 12/1974 | Suzukawa et al. | 425/7 |

FOREIGN PATENT DOCUMENTS

| | | | |
|---|---|---|---|
| 2459131 | 6/1975 | Fed. Rep. of Germany | 425/7 |

*Primary Examiner*—Robert L. Spicer, Jr.

*Attorney, Agent, or Firm*—Haseltine, Lake & Waters

[57] ABSTRACT

A device for the manufacture of spherical metallic powder comprising a vertical cylinder-conical vessel having in an upper part, means for introduction of a stream of liquid metal and for atomizing said stream using jets of gas and, in a lower part, gas inlet means for producing upwardly inclined tangential jets of gas for generating vortices along an ascending spiral centered on the axis of the vessel. The device also comprises a gas outlet connected to a cyclone dust remover whereby metal powder carried by the gas is separated from the gas, the gas outlet of the cyclone dust remover being connected to the gas inlet means and the dust outlet of the cyclone dust remover being connected to a duct opening into the vessel in the immediate vicinity of the jets produced by the gas inlet means.

6 Claims, 4 Drawing Figures

DEVICE FOR THE MANUFACTURE OF SPHERICAL METALLIC POWDER

The present invention relates to the manufacture of a spherical metallic powder which is uncontaminated by the surrounding atmosphere.

French Pat. No. 7345788 describes a device for the manufacture of a metallic powder by atomizing a liquid jet of metal, which device consists of a vertical cylindro-conical vessel with cooled walls, which receives the liquid metal at the top and comprises, in its upper part, a ring equipped with atomizing injectors and an outlet for gas charged with dust, and, in its lower part, a funnel for discharging the manufactured powder, and gas inlet means for providing at least one jet of gas arranged tangentially to an imaginary cylinder which is centered on the axis of the vessel and passes through the outlet orifice of the or each jet forming gas inlet means.

The device according to the invention is particularly useful in the manufacture of a spherical metallic powder whose particle size is between 10 and 1,500 microns.

By introducing gas into the lower part of the vessel, in the form of one or more jets tangential to an imaginary cylinder centered on the axis of the vessel, there are generated, inside the vessel, vortices of gas charged with fine particles of metallic powder, the vortices being generated along an ascending spiral. These vortices, by multiplying the impacts between the cooled walls of the vessel and the fine particles of powder, lead to a high level of heat exchange between the whole of the gas and the falling powder inside the vessel and the cooled walls of the vessel. Such a device makes it possible to achieve a high rate of atomization with a vessel of small size.

In one of the embodiments described in the above referred to patent, the gas introduced into the lower part of the vessel is derived from gas taken from the gas outlet located in the upper part of the vessel, this gas having been freed from dust in a cyclone dust remover with cooled walls and being injected under low pressure into the lower part of the vessel through two pipes, the fan of the cyclone dust remover being the element which circulates the gas.

According to the present invention there is provided a device for the manufacture of a metallic powder by atomizing liquid metal, the device comprising a vertical cylindro-conical vessel having cooled walls comprising:

in its upper part, means for introducing a stream of liquid metal into said vessel, means for atomizing the stream of metal using jets of gas under pressure, and at least one gas outlet for gas charged with fine particles of the metal, in its lower part, a funnel for receiving and discharging the powder, in its lower half, gas inlet means for providing one or more jets of gas tangentially to a common cylinder centered on the axis of said vessel and forming an angle of between between 0° and 60° with a horizontal plane, for generating vortices of gas charged with fine particles of the metal along an ascending spiral centered on the axis of said vessel so as to multiply the impacts between the fine particles of the powder and the cooled walls of said vessel and thus to increase the heat exchanges between the matter located in said vessel, consisting of the gas and the falling powder, and the cooled wall of said vessel, a cyclone dust remover having cooled walls connected between said gas outlet and said gas inlet means including a fan operable to cause circulation of gas between said gas outlet and said gas inlet means located in the lower half of said vessel wherein a duct is provided joining the funnel of said cyclone dust remover to an orifice communicating with said vessel in the immediate vicinity of said gas inlet means, said duct allowing the fine particles of the powder recovered by said dust remover, to be reintroduced into said vessel.

The invention will be more fully understood from the following description of embodiments thereof, given by way of example only with reference to the accompanying drawings, in which FIG. 1 is a vertical schematic representation of a device in accordance with the present invention.

Figure 1:
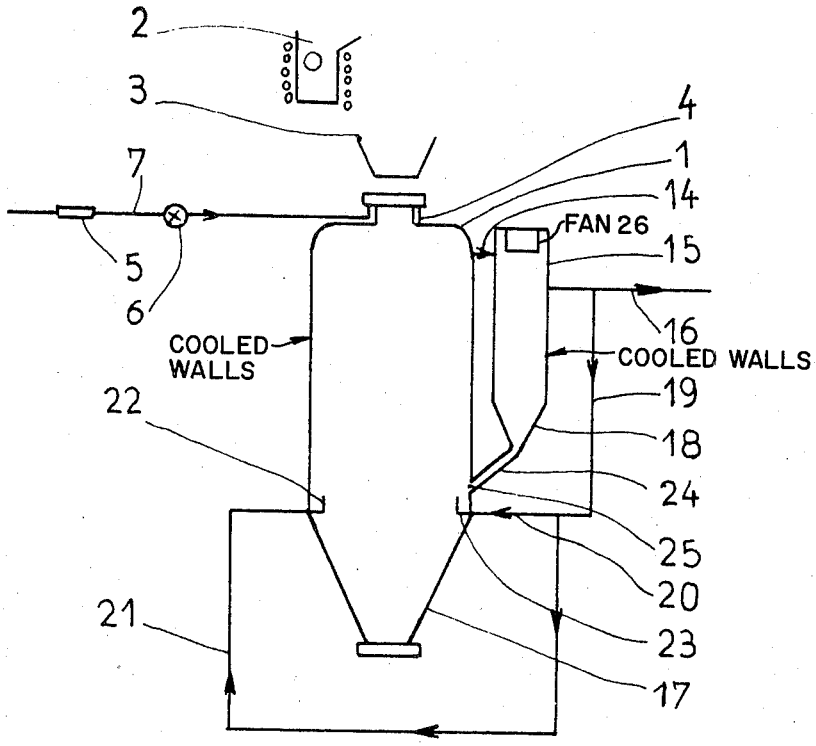
Figure 4:
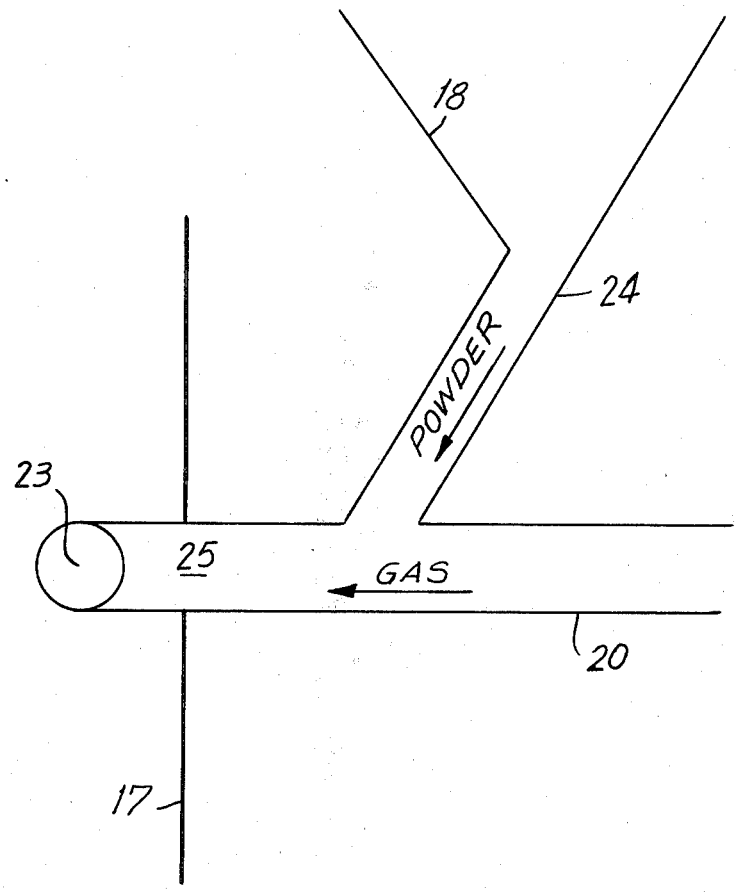

FIG. 4 is an enlarged schematic view of lines 20 and 24 of FIG. 1 showing orifice 25 formed directly in injector 23.

As shown in the drawing the vertical cylindro-conical reactor 1 is supplied through the top with liquid metal from a high frequency furnace 2 from which liquid steel is poured into an intermediate ladle 3. The upper part of the reactor 1 comprises an atomizing ring 4, comprising six gas injectors which are not shown and which introduce nitrogen gas under a pressure of 12 bars obliquely, towards the axis of the reactor and in a downward direction, the injected gas causing the vertical flow of liquid steel coming from the ladle 3 to break up into numerous droplets.

The pressure of the atomizing nitrogen is reduced to 12 bars by means of a pressure-reducer 5, and its introduction is controlled by means of a valve 6, the pressure-reducer and valve being located on the inlet line 7.

In the upper part of the reactor, the nitrogen charged with fine particles of powder escapes through line 14 and passes into a cyclone dust remover 15.

The gas for creating the vortices as described in the above referred to patent is taken, at low pressure, from the dust remover 15 along outlet line 16, after removal of dust, and is subdivided, by means of line 19, into two streams 20 and 21 which feed tangential injectors 22 and 23 inclined upwards at 30° relative to a horizontal plane. The fan 26 of the cyclone dust remover 15 is the element circulating the gas in the lines 19, 20 and 21 and in the injectors 22 and 23.

A line 24 connects the recovery funnel 18 of the cyclone dust remover 15 to an orifice 25 in the reactor, located in the immediate vicinity of the injector 23. The whole of the powder thus manufactured is collected in the funnel 17 located at the bottom of the reactor 1.

According to a first embodiment, the line 24 is a tube of about 6 cm diameter, which at all times forms an angle greater than 45° with the horizontal plane, so that the fine particles of powder flow from the funnel 18 to the orifice 25 under the effect of their own weight.

Figure 2:
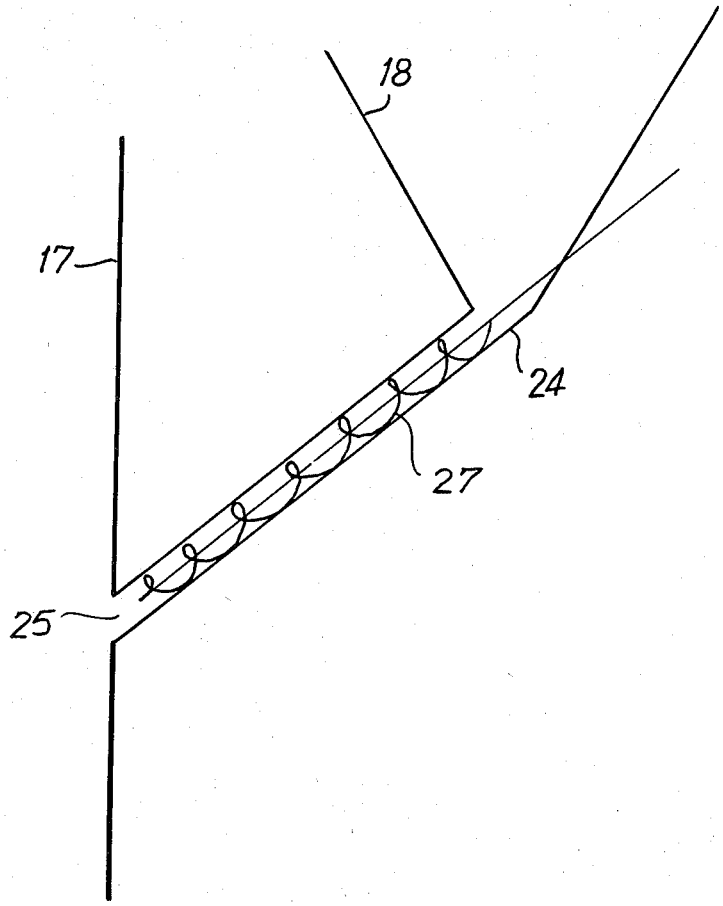
FIG. 2 is an enlarged schematic view of line 24 of FIG. 1 showing an endless worm as mechanical means disposed therein.

According to a second embodiment, shown in FIG. 2, a mechanical system of the endless worm type 27 causes forced movement of the fine particles of powder in the line 24 from the funnel 18 to the orifice 25. The advantage of this embodiment is that it makes it possible to place the cyclone dust remover 15 in any position relative to the reactor 1, as well as to avoid the risk of blocking of the line 24 and to control the temperature in the reactor by regulating the rate at which fine particles of powder are reinjected into the reactor.

Figure 3:
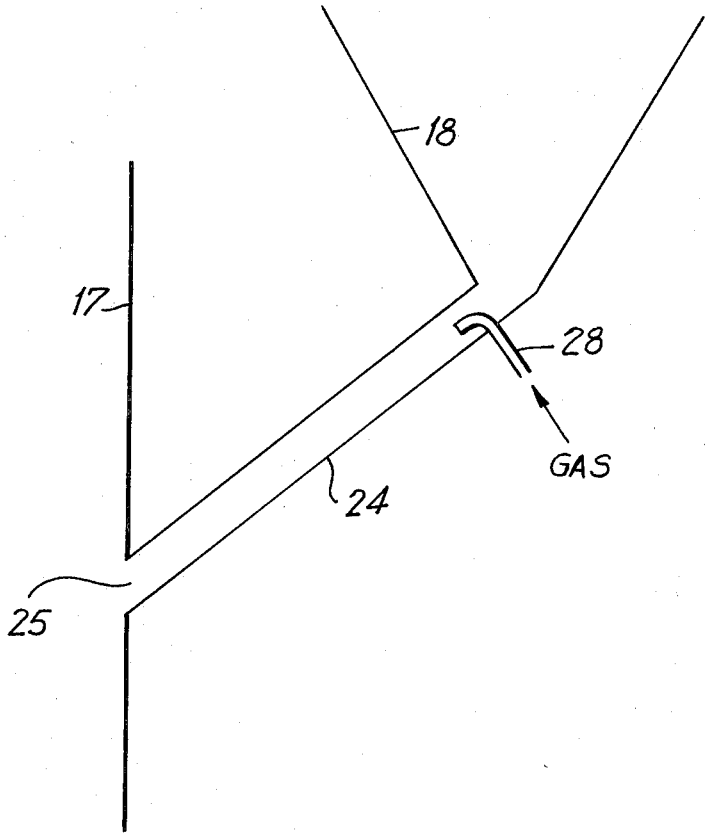
FIG. 3 is an enlarged schematic view of line 24 of FIG. 1 showing pneumatic means disposed therein.

According to a third embodiment, shown in FIG. 3, a pneumatic means 28 in line 24 permits a stream of gas to aid the flow of the fine particles of powder from the funnel 18 of the dust remover 15 into the funnel 17.

According to a fourth embodiment, shown in FIG. 4, the orifice 25 is formed directly in one of the injectors 22 or 23, which permits more rapid mixing of the gas, which generates the vortices, with the fine particles of powder.

There is thus provided a device wherein it is possible to re-inject into the vessel the fine particles of powder carried away by the gas issuing through the gas outlet, at the rate at which this gas is freed from dust by the cyclone dust remover. These fine particles, which have been cooled whilst passing through the dust remover, are re-injected near the gas inlet means located in the lower part of the vessel, which results in a higher concentration of fine particles in the gas vortices charged with fine particles, thus correspondingly increasing the heat exchange between the cooled walls of the vessel and the gases and powders contained in the vessel. A second advantage is that the device allows the powder to be recovered at a single point, through the funnel provided for this purpose, at the lowest point of the main vessel.

What is claimed is:

1. In a device for the manufacture of a metallic powder by atomizing liquid metal, the device comprising a vertical cylindro-conical vessel having cooled walls comprising:

in its upper part, means for introducing a stream of liquid metal into said vessel, means for atomizing the stream of metal using jets of gas under pressure, and at least one gas outlet for gas charged with fine particles of the metal, in its lower part, a funnel for receiving and discharging the powder, in its lower half, gas inlet means for providing one or more jets of gas tangentially to a common cylinder centered on the axis of said vessel and forming an angle of between 0° and 60° with a horizontal plane, for generating vortices of gas charged with fine particles of the metal along an ascending spiral centered on the axis of said vessel so as to multiply the impacts between the fine particles of the powder and the cooled walls of said vessel and thus to increase the heat exchanges between the matter located in said vessel, consisting of the gas and the falling powder, and the cooled walls of said vessel, a cyclone dust remover having cooled walls and connected between said gas outlet means and having a fan operable to cause circulation of gas between said gas outlet and said gas inlet means located in the lower half of said vessel the improvement consisting of a duct joining the funnel of said cyclone dust remover to said vessel in the immediate vicinity of said gas inlet means, said duct allowing the fine particles of the powder recovered by said dust remover to be reintroduced into said vessel.

2. A device according to claim 1, wherein said duct joining said funnel of said cyclone dust remover to said vessel at all times forms an angle greater than 45° with the horizontal plane, the lower end of said duct being that connected to said vessel so that the fine particles of said powder, recovered by said dust remover, flow under their own weight into said vessel.

3. A device according to claim 1, including a mechanical system located in said duct joining said funnel of the cyclone dust remover to said vessel for causing the fine particles of powder recovered by said dust remover to flow from said funnel of said dust remover into said vessel.

4. A device according to claim 1, wherein said duct is connected directly to said gas inlet means.

5. A device according to claim 1, including a pneumatic means located in said duct joining said funnel of the cyclone dust remover to said vessel for causing the fine particles of powder recovered by said dust remover to flow from said funnel of said dust remover into said vessel.

6. A device according to claim 3 wherein said mechanical system in an endless worm type.

* * * * *